US008033925B2

(12) United States Patent
Hardage

(10) Patent No.: US 8,033,925 B2
(45) Date of Patent: Oct. 11, 2011

(54) GOLF PUTTING AND SWING AID APPARATUS

(76) Inventor: George E. Hardage, Olathe, KS (US)

( * ) Notice: Subject to any disclaimer, the term of this patent is extended or adjusted under 35 U.S.C. 154(b) by 0 days.

(21) Appl. No.: 12/794,040

(22) Filed: Jun. 4, 2010

(65) Prior Publication Data

US 2010/0311513 A1 Dec. 9, 2010

Related U.S. Application Data

(60) Provisional application No. 61/184,151, filed on Jun. 4, 2009.

(51) Int. Cl.
*A63B 69/36* (2006.01)
*A41D 19/00* (2006.01)

(52) U.S. Cl. ..... 473/205; 2/161.2

(58) Field of Classification Search ..... 473/201, 473/202, 205, 207, 212; 434/252, 365, 392; 2/160, 161.1, 161.2, 161.3, 161.4, 161.6, 2/163
See application file for complete search history.

(56) References Cited

U.S. PATENT DOCUMENTS

| | | | | |
|---|---|---|---|---|
| 5,655,223 | A * | 8/1997 | Cozza | 2/161.2 |
| 5,733,201 | A * | 3/1998 | Caldwell et al. | 473/202 |
| 5,771,492 | A | 6/1998 | Cozza | |
| 6,016,103 | A * | 1/2000 | Leavitt | 340/575 |
| 6,772,442 | B2 | 8/2004 | Erker | |
| 7,780,541 | B2 * | 8/2010 | Bauer | 473/205 |
| 2002/0194668 | A1 * | 12/2002 | Kwon | 2/161.4 |
| 2008/0189827 | A1 * | 8/2008 | Bauer | 2/161.2 |

* cited by examiner

*Primary Examiner* — Nini Legesse
(74) *Attorney, Agent, or Firm* — Hovey Williams LLP

(57) ABSTRACT

A pressure sensing and notification system to be worn by a golfer to facilitate proper putting and swing techniques. The system indicates to the golfer via a physically-detectable signal that is transmitted to the golfer instantly in response to the golfer handling a club with excessive pressure.

17 Claims, 4 Drawing Sheets

GOLF PUTTING AND SWING AID APPARATUS

RELATED APPLICATION

This application claims the priority benefit of U.S. Provisional Application Ser. No. 61/184,151, filed Jun. 4, 2009, titled GOLF PUTTING AID, which is hereby incorporated in its entirety by reference herein.

BACKGROUND

1. Field

The present inventive concept relates generally to athlete-training aids. More specifically, embodiments of the present inventive concept concern a device to be worn by an athletic to provide feedback responsive to the athlete's performance while golfing.

2. Discussion of Prior Art

Proper putting technique is critical to successful play of golf. While putting, there are a variety of factors that a golfer must track to ensure desirable contact between a putter and a golf ball and resultant travel of the golf ball. Such factors include aim, velocity, form, and grip.

Golfers commonly err with respect to the factors of velocity, form, and grip. Tendencies include undesirable pushing or pulling of the putter, decelerating the putter mid-swing, and griping the putter too tight. Any one of these errors may cause the golf ball to travel undesirably. In view of the plurality of tendencies, it is difficult to identify a cause of an error to avoid repeating it. Similar problems are present when a golfer swings a club, particularly during chipping and pitching.

Popular putter-grip styles vary among individuals and include the single interlock, the double interlock, the single overlap, and the baseball grip. The aforementioned errors are common to each of these grip styles.

Conventional training aid devices suffer from various limitations. For instance, conventional devices generally provide untimely feedback with limited detail, which prevents a user from pinpointing an error. Additionally, conventional devices are generally not adaptable to accommodate users of different strength, style, and skill level, which prevents optimization for an individual user.

SUMMARY

The following brief summary is provided to indicate the nature of the subject matter disclosed herein. While certain aspects of the present inventive concept are described below, the summary is not intended to limit the scope of the present inventive concept.

Embodiments of the present inventive concept provide an athletic training aid that does not suffer from the problems and limitations of conventional training aids, such as those set forth above.

The present inventive concept broadly concerns a sensing and notification system to be worn by a golfer to teach proper puttering and swing technique by indicating to the golfer via a physically-detectable signal that is transmitted to the golfer instantly in response to a sensed improper technique.

According to one aspect of the present inventive concept, the apparatus includes a glove dimensioned and configured to be received on a hand of a user. The glove presents a contact region on a palm side thereof. The apparatus further includes a controller and a sensor mounted to the contact region to detect a condition of the contact region and communicate the condition to the controller. The apparatus also includes an indicator connected to the controller to generate a physically-perceivable signal if activated by the controller. The controller is operable to activate the indicator if the condition exceeds a predetermined value.

According to a preferred embodiment of the present inventive concept, the assembly broadly includes a printed circuit board electrically connected to a pressure sensor and a vibrator. The pressure sensor includes an elongated, flexible body that extends longitudinally along and about a middle finger of the golfer. The vibrator is activated by the controller to deliver the physically-detectable signal if the pressure sensor detects pressure in excess of a predetermined value that is selected from one of a plurality of values.

Additional aspects, advantages, and utilities of the present inventive concept will be set forth in part in the description which follows and, in part, will be obvious from the description, or may be learned by practice of the general inventive concept.

BRIEF DESCRIPTION OF THE DRAWING FIGURES

Preferred embodiments of the present inventive concept are described in detail below with reference to the attached drawing figures, wherein.

Figure 1:
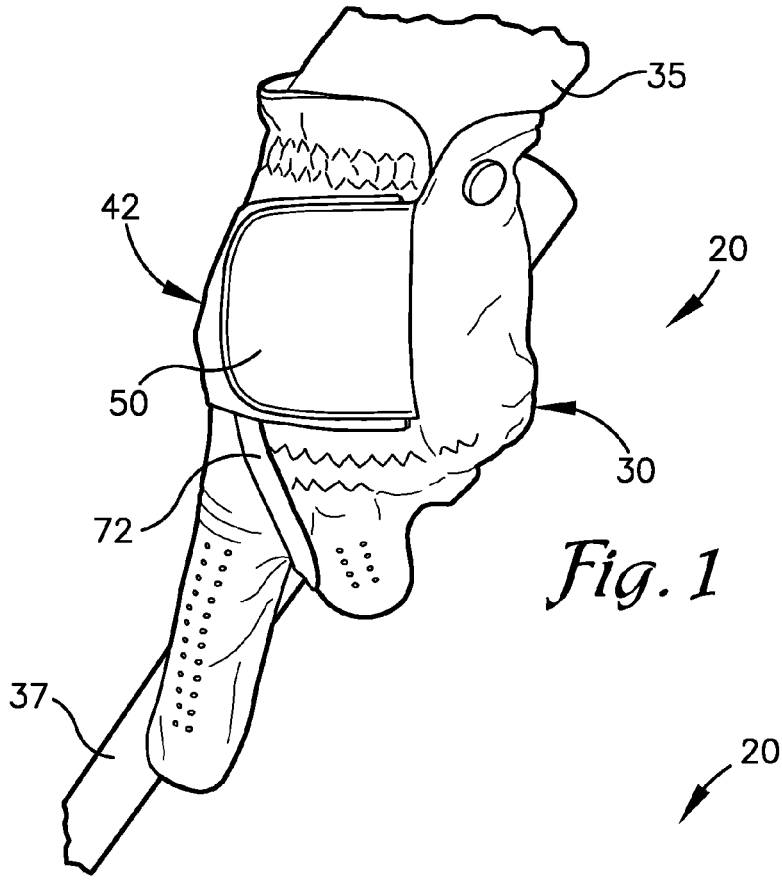
FIG. 1 is a front perspective view of a golf training system, in accordance with first embodiment of the present inventive concept, illustrating a user gripping a shaft of a putter with a golf glove.
Figure 5:
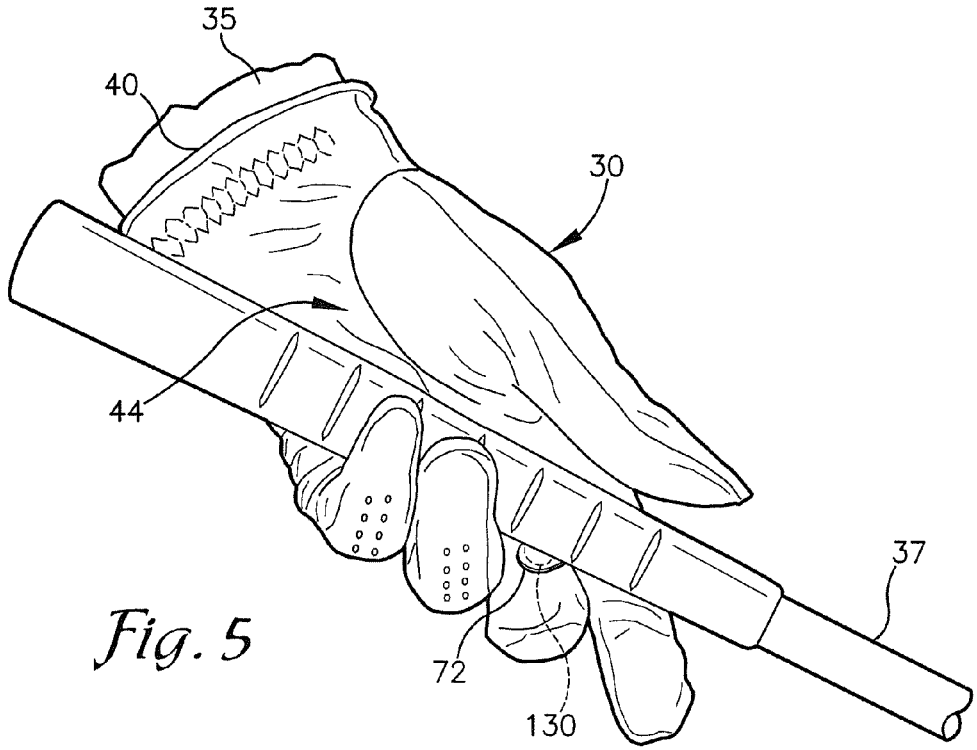
Figure 6:
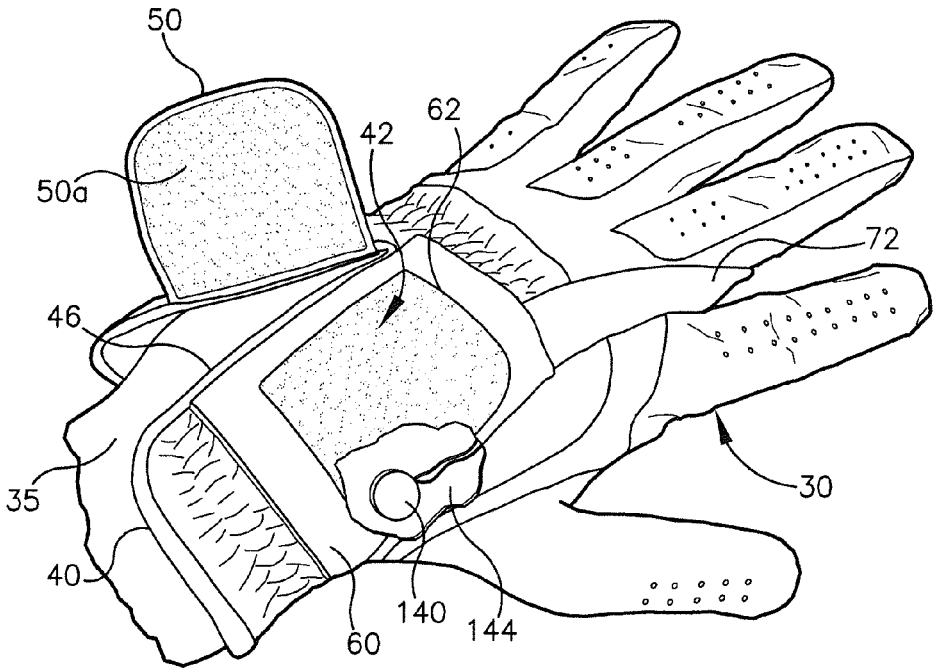

FIG. 5 is a rear perspective view of the golf training system illustrated in FIG. 1 illustrating the sensor on the palm side of the glove in contact with the putter; and FIG. 6 is a front right perspective view of the golf training system illustrated in FIG. 1 with the first flap of the glove in the open configuration and the second flap of the glove in a closed configuration to expose an engagement section for the first flap on the second flap.

The drawing figures do not limit the present inventive concept to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning to FIGS. 1 and 5, a golf training system 20 is illustrated in a first embodiment in the form of a golf glove 30 that is configured to receive a hand 35 for gripping a golf club shaft 37.

The glove 30 is made of knit, natural leather, and/or synthetic material and includes an opening 40 through which the hand 35 is received, with the opening 40 being defined between a backhand side 42 and a palm side 44. A slit 46 extends from the proximal end of the backhand side 42 and the palm region 44 to facilitate entry of the hand 35 into the opening 40 by permitting expansion of the opening 40.

Figure 2:
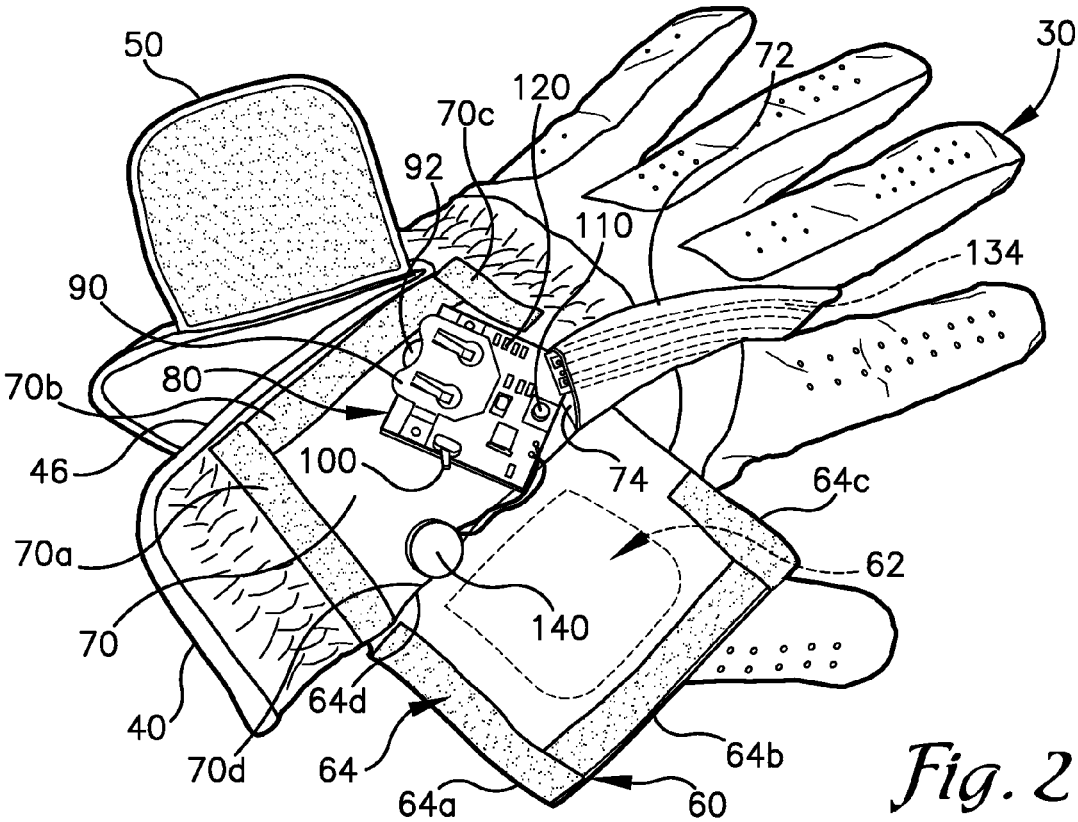
FIG. 2 is a front right perspective view of the golf training system illustrated in FIG. 1 with a first flap and a second flap of the glove in an open configuration to expose a printed circuit board and a passage opening on a backhand side of the glove.

Turning to FIGS. 2 and 6, the glove 30 includes a first flap 50 that folds over and attaches to a second flap 60. Each of the flaps 50 and 60 have an attachment end sewn to the glove 30, and may be moved to and from an open configuration, as illustrated in FIG. 2, and a closed configuration, as illustrated in FIG. 1. It is foreseen that the flaps 50 and 60 may be attached to the glove 30 by means other than sewing, for example, by hook-and-loop material, without departing from the scope of the present inventive concept.

The first flap 50 extends parallel with respect to the opening 40 from a left side of the glove 30, across the slit 44, and may be selectively secured to a section 62 of the second flap 60 on a right side of the glove 30, as illustrated in FIG. 6. The first flap 50 has a hook-and-loop material section 50*a* that is attached to the section 62 of the second flap 60, which also comprises hook-and-loop material to permit adjustable engagement of the first flap 50 with the second flap 60. The adjustable engagement enables the user to selectively position the first flap 50 in one of a variety of closed configurations along a length of the section 62 of the second flap 60, which defines a size of the opening 40 of the glove 30. In this manner, the user may select a desired fit of the glove 30.

When the first flap 40 is in the open configuration, as illustrated by FIG. 2, the slit 44 is exposed so that the opening 40 may be expanded. When the opening 40 is expanded, entry and removal of the hand 35 into and out of the opening 40 is facilitated.

The second flap 60 extends laterally from the right side of the glove 30, adjacent to the opening 40, parallel to the first flap 50, and up to the slit 44. The second flap 60 may only be moved to and from the open and closed configurations when the first flap 50 is in the open configuration and the second flap 60 is exposed. The second flap 60 is selectively secured to the glove 30 in the closed configuration using hook-and-loop material oriented partially along a perimeter 64 of the second flap. In the illustrated embodiment, the hook-and-loop material extends entirely along a first side 64*a* and a second side 64*b* of the second flap 60, partially along a third side 64*c* of the second flap 60, and does not extend along a fourth side 64*d* of the second flap 60 that is sewn to the glove 30.

When the second flap 60 is in the closed configuration, the second flap 60 forms a compartment 70 that is arranged on a backhand side 42 of the glove 30 to house a printed circuit board (PCB) 80 to control the system 20 therein. The PCB 80 is removable from the compartment 70 to enable washing of the glove 30.

The compartment 70 includes hook-and-loop material that extends entirely along a first side 70*a* and a second side 70*b*, and partially along a third side 70*c* of the compartment 70, which are respectively securable to the first side 60*a*, the second side 60*b*, and the third side 60*c* of the second flap 60. Hook-and-loop material does not extend along a fourth side 70*d* of the compartment 70, which abuts the sewn end 60*d* of the second flap 60.

Figure 3:
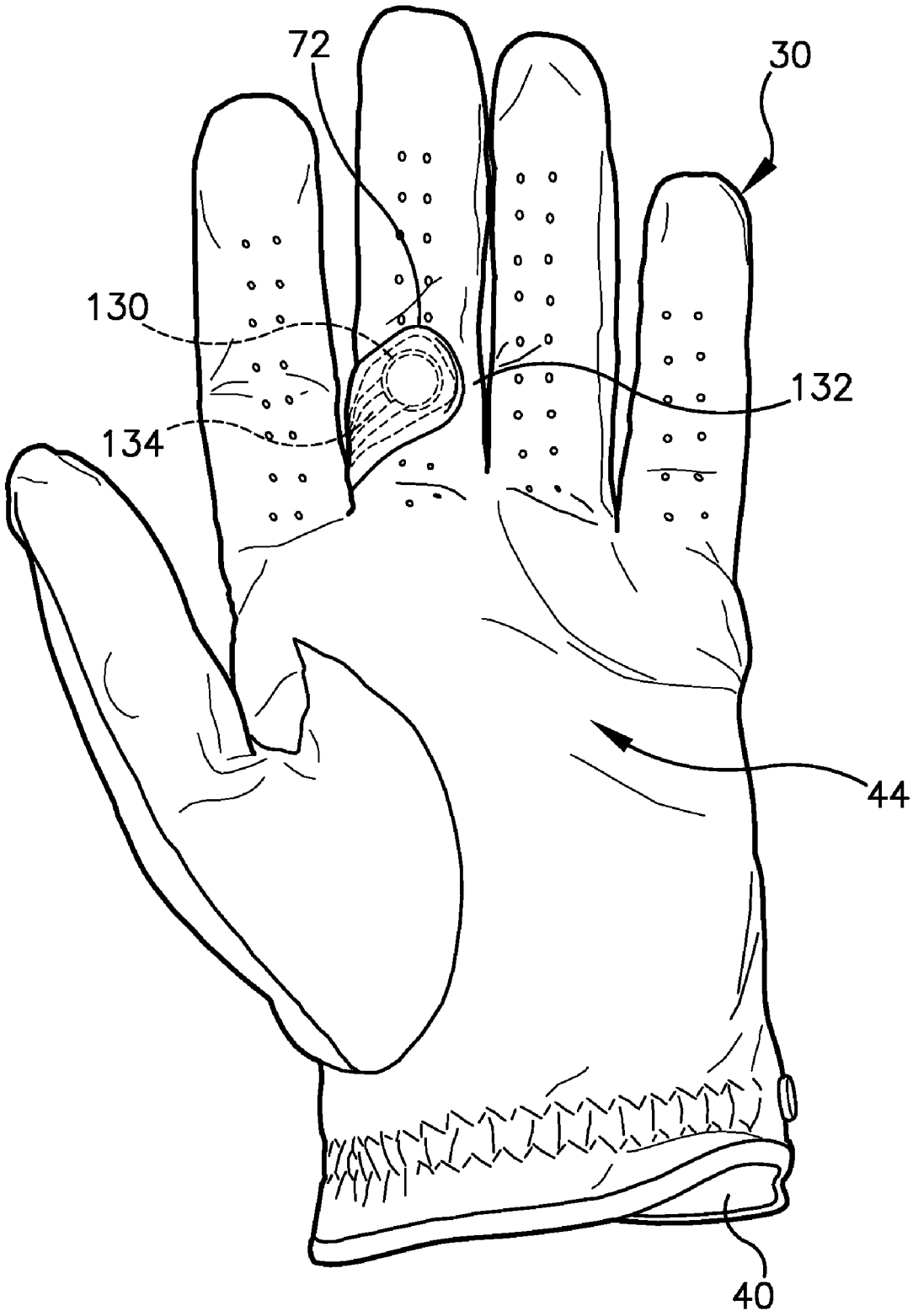
FIG. 3 is a bottom plan view of the golf training system illustrated in FIG. 1 with a sensor positioned on a contact point of a palm side of the glove.

Turning to FIG. 3, the compartment 70 encloses a portion of an elongated pocket 72 and an opening 74 thereof. The pocket 72 extends from the compartment 70 at the third side 64*c* of the second flap 60 adjacent to the hook-and-loop material of the third side 64*c* of the second flap 60. The pocket 72 extends longitudinally along and about a portion of the glove 30 that corresponds to a middle finger of the hand 35 and terminates at the palm region 44 of the glove 30.

In the first embodiment, the compartment 70 is arranged on the backhand side 42 of the glove 30, as illustrated in FIG. 2, such that the PCB 80 is carried by the glove 30. It is foreseen, however, that the PCB 80 need not be attached to the user, but could remotely control the system 20, for example via wireless communication, without departing from the scope of the present inventive concept.

Figure 4:
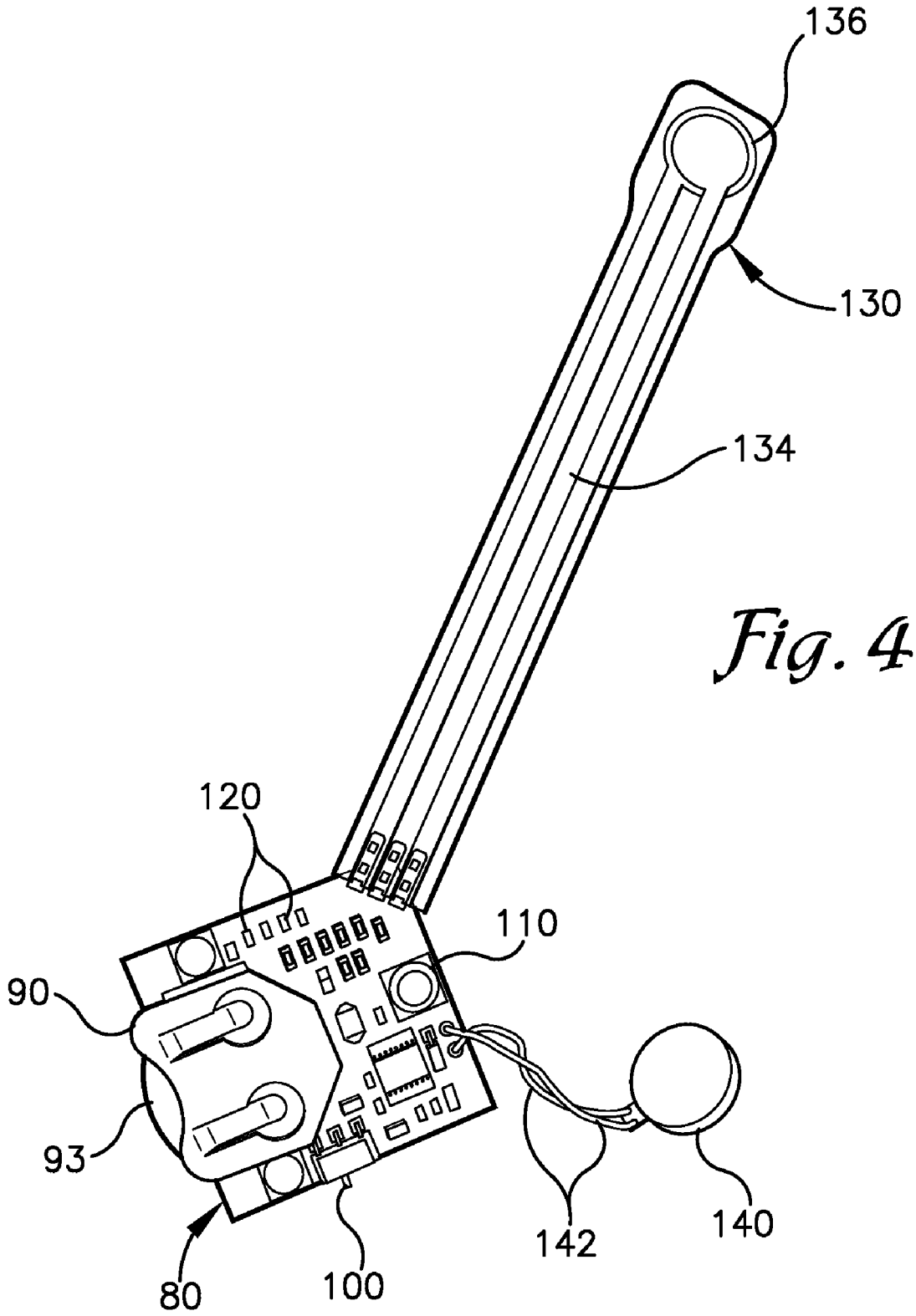
FIG. 4 is a top plan view of the golf training system illustrated in FIG. 1 illustrating the printed circuit board.

Turning to FIG. 4, the PCB 80 includes a battery compartment 90, a power switch 100, a settings switch 110, and a plurality of light emitting diodes (LEDs) 120 mounted thereon and is electrically connected to a sensor 130 and a vibrator 140.

The battery compartment 90 is sized and shaped to receive a 3-volt battery 93 that may be introduced to or removed from the battery compartment 90 when the PCB 80 is exposed. It is foreseen, however, that any battery of sufficient voltage to power the system 20 could be used without departing from the scope of the present inventive concept. Alternatively, the system 20 may be powered by an external power source, such as but not limited to a power source of another electronic device, such as an IPHONE® or the like, without departing from the scope of the present inventive concept.

When the first flap 50 and the second flap 60 are in their open configurations, as illustrated in FIG. 2, the power switch 100 is exposed to enable activation and deactivation of the system 20 by manipulating the power switch 100. It is foreseen that the system 20 may be activated and deactivated by other means, such as by a motion-detector switch without departing from the scope of the present inventive concept. In this manner, the motion-detector switch activates the system 20 when the hand 35 is in motion and deactivates the system 20 when the hand 35 or system 20 is at rest, e.g., after a predetermined time period, which advantageously provides ease of use and power conservation.

The settings switch 110 is operable to permit selection of one of a plurality of pressure-sensitivity settings so that the user may adjust the system 20 with respect to ideal grip pressure, which differs depending on a variety of factors such as the user's age, gender, and ability. In the first embodiment, the plurality of settings range between 1 to 25 lbs and preferably include four settings such as two pounds, three pounds, four pounds, and five pounds. It is foreseen, however, that any pressure setting could be used depending on a particular user's needs. For instance, the system 20 may be manufactured so that the glove 30 has a plurality of different sizes and predetermined pressure settings to accommodate general user types, for example children, women, and men.

Additionally, the system 20 is programmable and may be connected to communicate with an external device to define one or more sensitivities within a sensor range, e.g., between one and one hundred pounds. In this manner, a wide variety of golfers of various ages, genders, and abilities could use of the system 20, which would be advantageous for a profession user, such as a golfing instructor. It is foreseen that the system 20 may be calibrated for a specific user prior to initial use and/or anytime thereafter.

The LEDs 120 include four LEDs 120 aligned on the PCB 80. The LEDs 120 cooperate with the settings switch 110 and are operable to visibly indicate to the user an activated/deactivated status and, if the system 20 is activated, a present pressure-sensitivity setting.

The LEDs 120 are operable to deactivate after manipulation of the setting switch 110, e.g., after a predetermined time period such as 5 seconds, and reactive when the settings switch 110 is again manipulated to conserve power. As such, if the settings switch 110 is manipulated and one or more of the LEDs 120 is illuminated, such indicate that the system 20 is activated. Similarly, if the settings switch 110 is manipulated and none of the LEDs 120 is illuminated, such indicates that the system 20 is deactivated.

When the pressure sensitivity is at its lowest setting, for example two pounds, a single, leftmost one of the LEDs 120 is illuminated if the settings switch 110 is manipulated. With each push of the settings switch 110 while one of the LEDs 120 is illuminated, a next, most adjacent one of the LEDs 120 activates and the prior one of the LEDs 120 deactivates to indicate an increase in pressure sensitivity. As such, only one of the LEDs 120 is illuminated at any one time. When a single, rightmost one of the LEDs 120 is illuminated, the pressure sensitivity is at its highest level, for example five pounds. If the settings switch 110 is manipulated when the rightmost one of the LEDs 120 is illuminated, the pressure sensitivity resets to its lowest setting and is capable of being increased as provided above. In this manner, the LEDs 120 provide an efficient means for communication and eliminate any ambiguity with respect to the present pressure-sensitivity setting. It is foreseen, that other illumination patterns could be used to convey status of the system 120 without departing from the scope of the present inventive concept.

The sensor 130 is a piezoresistive force sensor having an elongated flexible-printed circuit 134 that extends from the PCB 80 with a single button 136 of a pressure-sensitive ink at a distal end thereof. The sensor 130 is ultra-thin with a width of 0.0008 inch. In the first embodiment, the sensor 130 extends from the PCB 80 and into the pocket 72. In this manner, the pocket 72 guides the sensor 130 along and about a portion of the glove 30 that corresponds to a middle finger of the hand 35 and terminates at the palm side 44 of the glove 30 that corresponds to a contact point 132 between the glove 30 and the golf club shaft 37. In this manner, the button 136 is situated on the contact point 132 to sense a pressure between the golf club shaft 37 and the hand 35.

In the first embodiment, the system 20 comprises a single sensor 130 to sense pressure at the single contact point 132. It is foreseen, however, that multiple sensors could be routed to multiple contact points via multiple pockets without departing from the scope of the present inventive concept. For instance, one or more additional sensors may be added that extend from the PCB 80, through a pocket, and to a contact point on a portion of the glove 30 corresponding to another contact point between the hand 35 and the golf club shaft 37, such as a portion of the glove 30 corresponding to a thumb. It is foreseen that the sensor 130 could be attached to the glove 30 in another manner and/or be adjustable, e.g., using hook-and-loop material, without departing from the scope of the present inventive concept.

The system 20 employs the vibrator 140, which comprises a vibramotor device connected to the PCB 80 via wires 142. Upon activation, the vibrator 140 is operable to deliver a vibration that is physically-detectable by the user. Other physically-detectable signals such as audible and visible signals may alternatively be used and are within the ambit of the present inventive concept, however, the vibration signal is more preferred because an audible signal may distract others and a visible signal may detract from the user's swing as the user watches an indicator for the visible signal.

The vibrator 140 is activated if pressure sensed by the sensor 136 is greater than the pressure defined by the setting switch 110. Likewise, the vibrator 140 is deactivated if the pressure sensed by the sensor 136 is equal to or less than the pressure defined by the setting switch 110.

Again, in a secluded and/or teaching environment, it may be desirable that the signal be audible and/or visible, for example, so that another party such as an instructor can observe the signal and provide instruction. Thus, it is foreseen that the vibrator 140 could be substituted for or operate in sync with another signaling device capable of independent activation and operable to deliver another physically-detectable signal, such as an audible signal and/or a visible signal.

The vibrator 140 is attached to a region of the glove 30 that corresponds to a region of the user that is susceptible to receiving the vibration. In the first embodiment, the glove 30 positions the vibrator 140 on a portion of the glove 30 corresponding to a portion 144 of the hand 35 between metacarpal bones of the thumb and forefinger, which is a fleshy, sensitive area of the hand 35 relative to other areas of the hand 35. Notably, the compartment 70 extends onto this area of the hand 35 and the vibrator 140 is positioned therein.

In the first embodiment, the glove 30 is a full glove similar to a standard golf glove, but it is foreseen that the glove 30 may be a partial glove, i.e., a glove with one or more partial slots or no finger slots.

A second embodiment of a golf training system that is not illustrated, is described below. For the sake of brevity, the remaining description will focus primarily on the differences of this embodiment relative to the embodiment described above. The primary difference is substituting alternative attachment means for that provided by the glove 30.

Similar to the first embodiment, the second embodiment includes a PCB having a battery compartment, a power switch, a settings switch, and a plurality of LEDs mounted thereon and electrically connected to a sensor and a vibrator.

The PCB, sensor, and vibrator are positioned on the user in the same regions as like elements in the first embodiment, except that in the second embodiment, they are secured using independent straps that are sized and shaped to secure the PCB, sensor, and vibrator. It is foreseen that other attachment means may be substituted for the straps without departing from the scope of the present inventive concept.

The second embodiment enables the user to use the system without a glove or, in the alternative, to fit a glove over the system for use therewith.

The present inventive concept will now be described in use with respect to the first embodiment.

Returning to the first embodiment, to use the system 20, the user fits the glove 30 onto the hand 35 with the system 20 preferably deactivated. To facilitate entry of the hand 35 into the glove 30, the user may elect to move the first flap 50 to its open configuration to expand the slit 46 and increase a circumference of the opening 40 of the glove 30.

Once the glove is received onto the hand 35, the user may move the first flap 50 to its closed configuration by attaching the first flap 50 to any portion of the section 62 of the second flap 60, which causes the slit 46 to be closed and the circumference of the opening 40 to be decreased to snugly fit the hand 35.

The glove 35 may be used throughout a golf game with the system 20 activated or deactivated. However, because the system 20 is particularly suitable as a putting aid, it may be desirable for the system 20 to be maintained in a deactivated state until the user is preparing to putt so that power is conserved.

When the user is preparing to putt or swing a club and desires assistance from the system 20, the user moves the first flap 50 to its open configuration in order to access the second flap 60. The user may then move the second flap 60 to its open configuration to expose the PCB 80 within the compartment 70. With the PCB 80 exposed, the user may access and manipulate the power switch 100 to activate the system 20. If the user manipulates the power switch 100 and observes illumination of one or more of the LEDs 120, the system 20 is activated.

After activating the system 120, the user may observe the present pressure-sensitivity setting by noting a position of an illuminated one of the LEDs 120 as discussed previously. If the user desires a different pressure sensitivity, the user may alter such by manipulating the setting switch 110 until a desired pressure sensitivity is achieved.

With the system 20 activated and the pressure sensitivity set to a desired setting, the user may move the second flap 60 to its closed configuration to conceal the PCB 80 and move the first flap 50 to its closed configuration by attaching the first flap 50 to any portion of the section 62 of the second flap 60, which causes the slit 46 to be closed and the circumference of the opening 40 to be decreased to snugly fit the hand 35, as discussed previously. The user is now able to putt or swing a club with the aid of the system 20.

The user grips the golf club shaft 37 in one of a variety of grip styles including, but not limited to single interlock, the double interlock, the single overlap, and the baseball grip. In any one of these grip styles, the middle finger of the hand 35 engages the golf club shaft 37 at the contact point 132 on the palm side 44 of the glove 30. In this manner, the sensor 130 and particularly the button 136 thereof is situated between the hand 35 and the golf club shaft 37 and is operable to measure a pressure therebetween and communicate such to the PCB 80.

If the force between the hand 35 and the golf club shaft 37 exceeds the pressure sensitivity setting, the vibrator 140 is activated to alert the user to the excessive force. The vibrator 140 deactivates when the user reduces grip pressure force on the golf club shaft 37 by relaxing the grip.

With particular regard to a putting stroke, if the user pushes or pulls the putter, or decelerates the putter in mid-swing, such causes an increase in pressure. If the increase in pressure exceeds the pressure sensitivity setting, the vibrator 140 is activated to alert the user to the improper technique. Because the vibrator 140 is activated immediately upon detection of the excessive force, the user can pinpoint the error based on when the vibrator 140 is activated. For instance, if the vibrator 140 is activated when the putter is at rest, the system 20 is indicating that the user's grip on the golf club shaft 37 is too tight. Further, if the vibrator 140 is activated when the user is swinging the putter and before striking a golf ball, the system 20 is indicating that the user is pulling the putter or decelerating the putter mid-swing. Still further, if the vibrator 140 is activated when the user is swinging the putter and after striking a golf ball, the system 20 is indicating that the user is pushing the putter.

Any one of these indications may result in poor putting performance. Because the system 20 alerts the user immediately upon detection of a user error, i.e., excessive force pressure, the user may pinpoint and reduce the pressure.

The preferred forms of the present inventive concept described above are to be used as illustration only, and should not be utilized in a limiting sense in interpreting the scope of the present inventive concept. Obvious modifications to the preferred embodiments, as hereinabove set forth, could be readily made by those skilled in the art without departing from the spirit of the present inventive concept.

The inventors hereby state their intent to rely on the Doctrine of Equivalents to determine and assess the reasonably fair scope of the present inventive concept as pertains to any apparatus not materially departing from but outside the literal scope of the present inventive concept as set forth in the following claims.

What is claimed is:

1. A golf training apparatus operable to generate a physically-perceivable signal responsive to improper technique, said apparatus comprising:

a glove dimensioned and configured to be received on a hand of a user, said glove presenting a contact region on a palm side thereof;

a controller;

a sensor mounted to said contact region to detect a condition of said contact region and communicate said condition to said controller;

an indicator connected to said controller to generate a physically-perceivable signal if activated by said controller, said controller being operable to activate said indicator if said condition exceeds a predetermined value, said condition is force on said sensor; and a selector on said controller to define said predetermined value from one of a plurality of force-sensitivity settings.

2. The apparatus according to claim 1, said contact region is a point of engagement between said glove and a golf club.

3. The apparatus according to claim 1, said physically-perceivable signal is a vibration deliverable to the hand.

4. The apparatus according to claim 1, said sensor is a piezoresistive force sensor having a flexible-printed circuit with a pressure-sensitive ink.

5. The apparatus according to claim 1, said plurality of force-sensitivity settings range from about 1 to 5 lbs.

6. The apparatus according to claim 1, said controller is secured to a backhand side of said glove, said glove including a plurality of slots dimensioned and configured to receive fingers of the hand of the user, said sensor extends longitudinally along one of said plurality of finger slots from said controller to said contact region.

7. The apparatus according to claim 6, said one of said plurality of slots corresponds to a slot for a middle finger of the hand of the user.

8. The apparatus according to claim 1, said glove including a first flap secured to a first side of said glove and a second flap secured to a second side of said glove.

9. The apparatus according to claim 8, said first flap and said second flap each having a closed configuration and an open configuration.

10. The apparatus according to claim 9, said first flap and said second flap extending toward each other in said closed configurations.

11. The apparatus according to claim 9, said second flap is removably secured to said glove in said closed configuration using hook-and-loop material thereby forming a compartment on said glove to secure said controller therein.

12. The apparatus according to claim 9, said second flap is removably secured to said glove in said closed configuration using hook-and-loop material that extends entirely along first and second perimeters of said second flap, and partially along a third perimeter of said second flap.

13. The apparatus according to claim 9, said second flap is only movable from said closed configuration to said open configuration when said first flap is in said open configuration.

14. The apparatus according to claim 9, said glove presenting a pocket to guide said sensor from said controller to said contact region, said pocket having an opening that is concealed when said first flap and said second flap are in said closed configurations.

15. A golf training apparatus operable to generate a physically-perceivable signal responsive to improper technique, said apparatus comprising:

a controller securable to a user;

a sensor securable to a contact region of the user to detect a condition of said contact region and communicate said condition to said controller;

an indicator connected to said controller and securable to a receiver region of said user to generate a physically-perceivable signal if activated by said controller, said controller being operable to activate said indicator if said condition exceeds a predetermined value, said condition is force on said sensor; and a selector on said controller to define said predetermined value from one of a plurality of force-sensitivity settings.

16. The apparatus according to claim 15, said contact region is a point of engagement between the user and a golf club.

17. The apparatus according to claim 15, said receiver region is a point on the user that is susceptible to receiving said physically-perceivable signal.

* * * * *